US011315782B2

(12) United States Patent
Traxler et al.

(10) Patent No.: US 11,315,782 B2
(45) Date of Patent: Apr. 26, 2022

(54) CATHODE MATERIAL

(71) Applicants: PLANSEE SE, Reutte (AT); OSRAM GMBH, Munich (DE)

(72) Inventors: Hannes Traxler, Reutte (AT); Ingmar Wesemann, Reutte (AT); Wolfram Knabl, Reutte (AT); Alexander Tautermann, Reutte (AT); Maria Nilius, Munich (DE)

(73) Assignees: Plansee SE, Reutte (AT); Osram GmbH, Munich (DE)

( * ) Notice: Subject to any disclaimer, the term of this patent is extended or adjusted under 35 U.S.C. 154(b) by 232 days.

(21) Appl. No.: 16/616,723

(22) PCT Filed: Apr. 26, 2018

(86) PCT No.: PCT/AT2018/000032
§ 371 (c)(1),
(2) Date: Nov. 25, 2019

(87) PCT Pub. No.: WO2018/213858
PCT Pub. Date: Nov. 29, 2018

(65) Prior Publication Data

US 2021/0175067 A1 Jun. 10, 2021

(30) Foreign Application Priority Data

May 23, 2017 (AT) ..... GM 121/2017

(51) Int. Cl.
*H01J 61/073* (2006.01)
*C22C 1/05* (2006.01)
*H01J 9/04* (2006.01)

(52) U.S. Cl.
CPC ..... *H01J 61/0735* (2013.01); *C22C 1/051* (2013.01); *H01J 9/04* (2013.01)

(58) Field of Classification Search
CPC ..... H01J 61/0735; H01J 9/04; C22C 1/051
See application file for complete search history.

(56) References Cited

U.S. PATENT DOCUMENTS 4,083,811 A 4/1978 Bachmann et al.
6,190,579 B1 2/2001 Billings
(Continued)

FOREIGN PATENT DOCUMENTS

CN 109378266 A * 2/2019 ..... H01J 9/04
EP 1481418 A1 12/2004
(Continued)

OTHER PUBLICATIONS

Hannes Traxler, et al.; "Carbon doping—A key for the substitute of thoriated tungsten"; International Journal of Refractory Metals and Hard Materials; vol. 74; Aug. 2018; pp. 93-98.

*Primary Examiner* — Donald L Raleigh
(74) *Attorney, Agent, or Firm* — Laurence A. Greenberg; Werner H. Stemer; Ralph E. Locher

(57) ABSTRACT

A cathode material for use in a high-pressure discharge lamp contains a matrix based on tungsten having a tungsten content of greater than or equal to 95% by weight, tungsten carbide, and oxides and/or predominantly oxidic phases of one or more emitter elements from the group of rare earth metals, Hf, and Zr. The cathode material additionally contains predominantly carbidic phases of the one or more emitter elements from the group of rare earth metals, Hf, and Zr. A high-pressure discharge lamp would contain such a cathode composed of the above cathode material.

17 Claims, 6 Drawing Sheets

(56) References Cited

U.S. PATENT DOCUMENTS

| | | | | |
|---|---|---|---|---|
| 7,279,839 | B2 | 10/2007 | Menzel et al. | |
| 7,652,430 | B1 | 1/2010 | Delgado | |
| 2010/0156294 | A1 | 6/2010 | Ikeuchi et al. | |
| 2012/0181925 | A1 | 7/2012 | Arimoto et al. | |
| 2014/0017114 | A1* | 1/2014 | Matsuo ..... | H01B 1/02<br>420/431 |

FOREIGN PATENT DOCUMENTS

| | | | |
|---|---|---|---|
| EP | 2690934 | A1 | 1/2014 |
| EP | 2796576 | A1 | 10/2014 |
| EP | 2801629 | A1 | 11/2014 |
| EP | 2857534 | A1 | 4/2015 |
| EP | 2871666 | A1 | 5/2015 |
| JP | 2010153292 | A | 7/2010 |
| JP | 2013020703 | A | 1/2013 |
| JP | 2015043270 | A | 3/2015 |
| WO | 03075310 | A1 | 9/2003 |
| WO | 2013113049 | A1 | 8/2013 |

* cited by examiner

Tmax = 2200°C

Tmax = 2700°C

CATHODE MATERIAL

BACKGROUND OF THE INVENTION

FIELD OF THE INVENTION

The invention relates to a cathode material for use in a high-pressure discharge lamp having the features of the preamble of the independent claim.

The invention further relates to a high-pressure discharge lamp which comprises a cathode composed of the cathode material of the invention and a process for producing a cathode material.

The task of the cathode of a high-pressure discharge lamp is to provide electrons at a sufficient current density. At typical current densities of high-pressure discharge lamps, this can be realized only at sufficiently high cathode temperatures, so that tungsten-based materials, in particular, have become established here because of the high melting point.

Failure of the high-pressure discharge lamp or a reduction in its performance frequently occurs because of changes in the morphology, structure and shape of the cathode and also an increase and/or local change in the electron work function during use of the cathode material. One of more of the following effects can occur:

- an increase in the cathode and/or anode temperature which due to evaporation of cathode and/or anode material leads to blackening of the bulb;
- a brief local change in the electric arc and, associated therewith, fluctuations in the light output (arc instability, also known as flickering);
- burning back of the cathode;
- change in shape of the cathode tip.

For high-power high-pressure discharge lamps, thoriated tungsten (W—$ThO_2$) is still preferably used as cathode material since this additive significantly reduces the electron work function (from, depending on the grain orientation, 4.6-5.4 eV for pure tungsten to 2.4-3.0 eV for W—$ThO_2$). However, since thorium is a radioactive element which emits alpha radiation, efforts have been made for decades to replace this material. These materials which reduce the electron work function, which are generally rare earth oxides, will hereinafter be referred to as "emitter materials". The emitter materials are usually added as oxide. During operation, a monolayer of the element concerned in elemental form is formed on the cathode tip as a result of the high temperatures. The effect of reducing the electron work function can be attributed to this layer. If, in the context of the present patent application, the actual chemical element (e.g. thorium or lanthanum) is meant, reference is made to "emitter element". "Emitter material", on the other hand, refers to the form in which the element is introduced. Thus, for example, $ThO_2$ is an emitter material and thorium is the corresponding emitter element.

Alternative emitter materials to $ThO_2$ have the disadvantage that they generally have a lower boiling point than $ThO_2$ and the cathode surface rapidly becomes depleted in the emitter material which reduces the electron work function. The oxide which reduces the electron work function cannot diffuse sufficiently quickly out from the volume of the electrode. Consequently, arc instability and increased burning away occur. The cathode does not attain a long life.

Thus, EP 1 481 418 A1 describes a tungsten cathode material which contains $La_2O_3$ and $ZrO_2$ or $HfO_2$ as emitter materials. However, melting of these oxides occurs in the region of the start of the electric arc because of their lower thermal stability compared to $ThO_2$. This leads to a local change in the coverage of the cathode with the emitter material, which is in turn reflected in increased arc instability. In addition, the originally fine particles become coarser during use of the cathode as a result of, for example, penetration of melt along grain boundaries. The inhomogeneous distribution of the emitter material resulting therefrom can also lead to instability of the electric arc.

SUMMARY OF THE INVENTION

It is an object of the present invention to provide a cathode material having the following properties:

- thorium-free;
- arc instability similar to or less than in the case of thoriated tungsten;
- low evaporation of the cathode material and thus low blackening of the bulb;
- shape stability of the cathode and low burning back of the cathode.

Furthermore, a high-pressure discharge lamp which displays a high and constant light yield over a long period of use and a similarly low or lower arc instability as a lamp having a thoriated cathode should be provided.

The invention preferably provides high-pressure discharge lamps for projection applications, in particular cinema projection, and also high-pressure discharge lamps for lithography applications. The high-pressure discharge lamps used for these purposes encompass, for example, short-arc xenon lamps and short-arc mercury vapor lamps.

This object is achieved by the features of the independent claims. Advantageous embodiments are subject matter of the dependent claims.

A cathode material according to the invention contains:

- a matrix based on tungsten having a tungsten content of greater than or equal to 95% by weight,
- tungsten carbide,
- oxides and/or predominantly oxidic phases of at least one or more emitter elements from the group of (rare earth metals, Hf, Zr), wherein the cathode material additionally contains predominantly carbidic phases of at least one or more emitter elements from the group of (rare earth metals, Hf, Zr).

In this context, "predominantly oxidic" means that the phase has a predominantly oxidic bonding character. The phase can deviate in respect of its composition from a nominal stoichiometry of an oxide. The same applies, mutatis mutandis, to the term "predominantly carbidic".

The emitter elements are thus selected from among the elements scandium, lanthanum, cerium, praseodymium, neodymium, promethium, samarium, europium, yttrium, gadolinium, terbium, dysprosium, holmium, erbium, thulium, ytterbium, lutetium and also hafnium and zirconium.

According to the invention, emitter elements are present both in an oxidic form and in a carbidic form in the microstructure.

The particular advantage of the presence of a carbidic phase of an emitter element is that reduction of an oxide of an emitter element by means of a carbide of an emitter element makes available increased molar amounts of the emitter element. When the reaction equation of the reduction of $La_2O_3$ and $W_2C$, namely $$La_2O_3(s)+3W_2C(s)\rightarrow 2La(s)+6W(s)+3CO(g), \quad \text{(I)}$$

is compared with the reaction equation of the reduction of $La_2O_3$ by means of $LaC_2$, namely $$La_2O_3(s)+1.5LaC_2(s)\rightarrow 3.5La(s)+3CO(g), \quad \text{(II)}$$

it is clear that an additional 1.5 mol of lanthanum compared to (I) are formed by the reduction of $La_2O_3$ by means of $LaC_2$, and this lanthanum is available as elemental lanthanum for diffusion into a surface region depleted in emitter element. It is also particularly advantageous that fewer moles of CO per mole of elemental lanthanum produced are formed in the reduction by means of a lanthanum carbide than in a reduction by means of $W_2C$. Since CO as reactant inhibits the progress of the reaction and has to be removed, a reaction in which fewer moles of CO are formed per mole of lanthanum is more favorable for the reaction kinetics.

The principle is not restricted to lanthanum, but can instead also be applied to the other emitter elements mentioned. It is also not necessary for the emitter element present as oxide to be the same as the emitter element present as carbide.

Elemental emitter element is resupplied to the surface from the volume (bulk) of the cathode material by means of the above-described reduction mechanism, and a lamp equipped with a cathode composed of the cathode material according to the invention achieves a long life at a uniform burning-away behavior.

Emitter elements are preferably one or more rare earth metals.

The tungsten carbide is preferably present as $W_2C$.

The proportion of tungsten carbide is preferably in the range from 0.1 to 4% by volume, particularly preferably from 0.5 to 2% by volume. The proportion of tungsten carbide in % by volume can be determined by means of quantitative analysis of the microstructure, as is described further below. A conversion into % by weight can be effected via the respective densities of the species. In a determination by chemical analysis, the content of tungsten carbide tends to be overestimated since part of the carbon is dissolved in the tungsten matrix.

The total carbon content of the cathode material is preferably 50-3000 μg/g, preferably 150-1500 μg/g and particularly preferably from 350 μg/g to 800 μg/g. At a carbon content below the limits indicated, a sufficient reducing action is not obtained; if the carbon content is higher, increased cathode deformation and/or increased blackening of the bulb is observed.

Furthermore, the proportion of the one or more emitter materials is preferably in the range from 0.5 to 5% by weight, preferably from 1.0 to 2.5% by weight and particularly preferably from 1.5 to 2% by weight.

The term emitter material is used to indicate the form in which the emitter element is introduced. The figures relate to the proportion by weight of the oxide of the emitter element when the latter is added as oxide. If different emitter materials are present, the figure relates to the proportion attained together. Indication of the proportion of emitter material in % by weight is particularly practical since the amount weighed in of the one or more emitter elements is effected via the respective emitter material.

It has been found that a very low solubility of the emitter element in the base material of the cathode material, generally tungsten, is desirable for sustained action of the emitter element during use. If the solubility is good, the emitter element diffuses into the volume of the cathode and is no longer available for formation of a monolayer on the cathode surface. The solubilities can be evaluated with the aid of the respective phase diagrams.

The emitter element which is present as oxide and/or predominantly oxidic phase is preferably, more preferably exclusively, formed by lanthanum.

Further preference is given to the emitter element which is present in predominantly carbidic form and/or as predominantly carbidic phase being formed by lanthanum.

Particular preference is given to both the emitter element which is present as oxide and/or predominantly oxidic phase and also the emitter element which is present in predominantly carbidic form and/or as predominantly carbidic phase being formed by lanthanum.

In other words, the emitter element is here formed by lanthanum which is present in oxidic and carbidic form in the cathode material.

Preference is given to the predominantly carbidic phases of one emitter element adjoining the oxidic phases of an emitter element. This results in particularly short diffusion paths in the reduction of the emitter oxide by the carbidic phase of the emitter element which takes place during operation.

Furthermore, it is preferred that the predominantly carbidic phases are configured as a shell or seam structure around particles of an emitter element present in oxidic form. In other words, any proportion of an emitter element which is present as predominantly carbidic phase is preferably present as shell or seam around the emitter elements present as oxide. This is particularly advantageous in respect of the diffusion paths for a reaction between the emitter elements present in carbidic form and oxidic form.

Particular preference is given to the shell or seam structure having an average thickness in the range from 0.01 to 1 μm, preferably from 0.05 to 0.8 μm, particularly preferably from 0.1 to 0.5 μm.

The cathode material preferably has a relative density of greater than or equal to 92%, preferably greater than or equal to 97%, particularly preferably greater than or equal to 99%. The relative density is the complement of the porosity. A relative density of, for example, 92% thus corresponds to a porosity of 8%. A high residual porosity results in a reduced thermal conductivity of the cathode material, which can lead to a rise in the peak temperature and premature failure of a lamp equipped therewith. In addition, the residual porosity decreases the strength and creep resistance of the cathode material at high temperature. The cathode material therefore particularly preferably has a relative density of greater than or equal to 99%, corresponding to a residual porosity of 1% or less.

Protection is also sought for a high-pressure discharge lamp containing a cathode composed of a cathode material according to any of the preceding claims.

Protection is also sought for a process for producing a cathode material, comprising the steps:

- production of a powder mixture containing tungsten powder, at least one emitter element from the group of (rare earth metals, Hf, Zr) and also at least one carbon source,
- pressing of the powder mixture,
- consolidation of the powder mixture in a consolidation step,
- wherein the process contains at least the following steps:
  - a diffusion step in the form of a heat treatment to bring about homogeneous distribution of carbon in the cathode material,
  - a precipitation step in the form of cooling to provide a carbon depot adjacent to a phase containing at least one emitter element.

The at least one emitter element can be added as hydride, oxide, hydroxide or nitride. The form in which it is introduced can be pulverulent. Doping with a liquid is also possible.

As carbon source, it is possible to add, for example, tungsten carbide or carbon black. Doping in liquid form as a carbon-containing suspension is also conceivable.

Consolidation of the powder mixture refers to a step which leads to a stable bond in the powder mixture. One customary method is sintering. Alternative methods are hot isostatic pressing (HIP) or powder forging.

The diffusion step is carried out as a heat treatment (also "ignition treatment") in which carbon goes into solution in the matrix formed by tungsten. The diffusion step can be carried out during the course of the consolidation step or be performed as a separate heat treatment step.

The diffusion step preferably takes place at temperatures of greater than or equal to 2200° C. but less than 3000° C. Below 2200° C., insufficient carbon goes into solution; above 3000° C., increased evaporation of carbon occurs.

In the following precipitation step in the form of cooling, the consolidated powder mixture which has been subjected to the diffusion step is cooled, as a result of which the solubility of carbon decreases and the carbon precipitates next to a phase containing at least one emitter element.

The precipitation step results in predominantly carbidic phases of the one or more emitter element being precipitated. The predominantly carbidic phases are formed as seam or shell around the emitter elements present in oxidic form. The precipitation step is carried out at a cooling rate of from 1 K/min to 500 K/min, preferably from 10 K/min to 100 K/min, particularly preferably from 20 K/min to 50 K/min.

Cooling rates in the range from 20 K/min to 50 K/m in have been found to be particularly advantageous for precipitation of carbidic emitter element around the emitter elements present in oxidic form.

BRIEF DESCRIPTION OF THE SEVERAL VIEWS OF THE DRAWING

The invention is illustrated in detail below by means of figures and production examples. The figures here show.

DESCRIPTION OF THE INVENTION

Figure 1A:
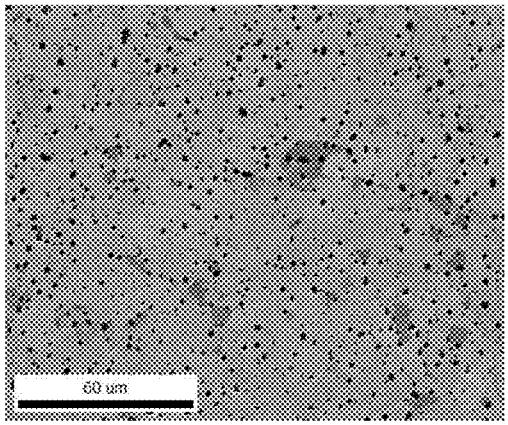
FIGS. 1*a* and 1*b* a secondary electron SEM (1*a*) and EBSD phase chart (1*b*) of a cathode material comprising tungsten+2% by weight of $La_2O_3$+800 μg/g of C FIG. 2 result of the X-ray diffraction measurement (XRD) on a cathode material comprising W+2% by weight of $La_2O_3$+800 μg/g of C FIGS. 3*a*-3*d* secondary electron image of a fracture surface (3*a*) and element distributions determined by means of Auger Electron Spectroscopy (AES): C (3*b*), La (3*c*) and W (3*d*), diffusion step at 2200° C.
Figure 1B:
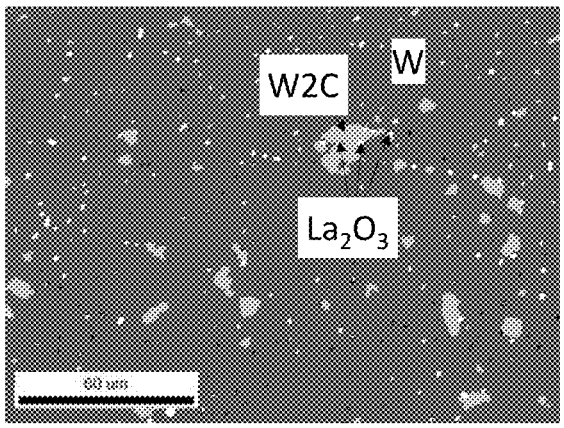

FIG. 1*a* shows a secondary electron scanning electron micrograph (SEM) of a cathode material comprising W+2% by weight of $La_2O_3$+800 μg/g of C. FIG. 1*b* shows the corresponding phase chart from electron backscatter diffraction (EBSD).

In this working example of the cathode material, lanthanum has thus been selected as emitter element. The dark-gray phase in FIG. 1*b* is the tungsten matrix, the light-gray phase is $W_2C$ and the white phase is $La_2O_3$.

It can be seen that the major part of the lanthanum oxide particles is removed in the preparation for use of the EBSD method. The phase chart shows that the material is made up not only of the W (tungsten) matrix and the lanthanum oxide particles but also of at least a carbidic phase ($W_2C$).

The average proportion by area of the $W_2C$ phase is 0.5% according to the analysis of 5 images. Assuming that the grains have no preferential orientation, the proportion by volume is equal to the proportion by area. The proportion by area of $W_2C$ of 0.5% corresponds to a proportion by mass of carbon of about 150 μg/g. As will be shown later, smaller amounts of carbon are also bound in seam-like accumulations right around the lanthanum oxide particles. It is assumed that the additional content of carbon has been forced to dissolve in the tungsten matrix.

On the basis of this information, the theoretical density of the material can be estimated. The composition based on W and containing 0.5% by volume of $W_2C$ and 2% by weight of $La_2O_3$ gives, taking into account the density of the individual phases (W 19.3 g/cm$^3$, $La_2O_3$ 6.51 g/cm$^3$, $W_2C$ 17.2 g/cm$^3$), a theoretical density of 18.56 g/cm$^3$. It may be noted that the effect of these small amounts of C on the density is relatively small. For comparison, the theoretical density of the material without addition of C (W+2% by weight of $La_2O_3$) is 18.57 g/cm$^3$.

Figure 2:
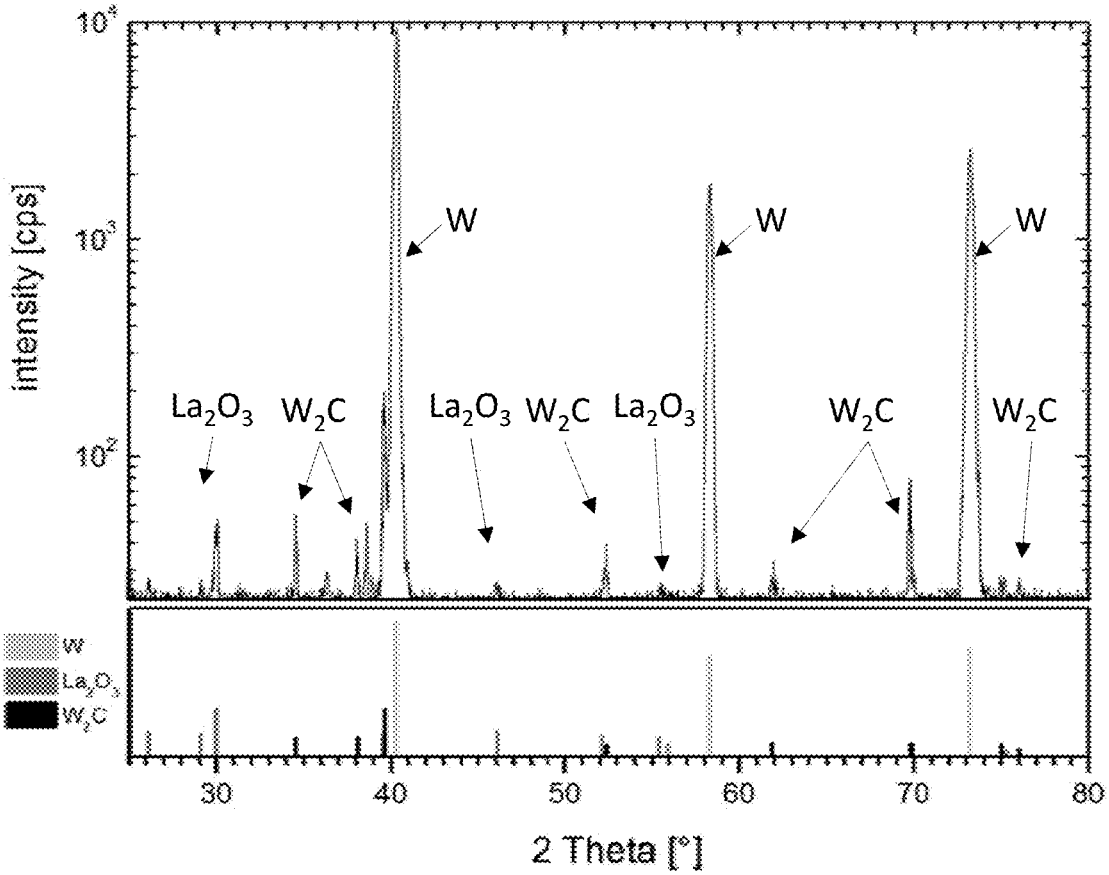

FIG. 2 shows the result of an X-ray diffraction measurement (XRD) on the cathode material comprising W+2% by weight of $La_2O_3$+800 μg/g of C. The $W_2C$ phase was able to be confirmed by agreement with the peak positions and heights recorded in the data bank. In the legend for the figure, the respective peak positions of the phases W (light gray), $La_2O_3$ (dark gray) and $W_2C$ (black) are indicated.

Figure 3A:
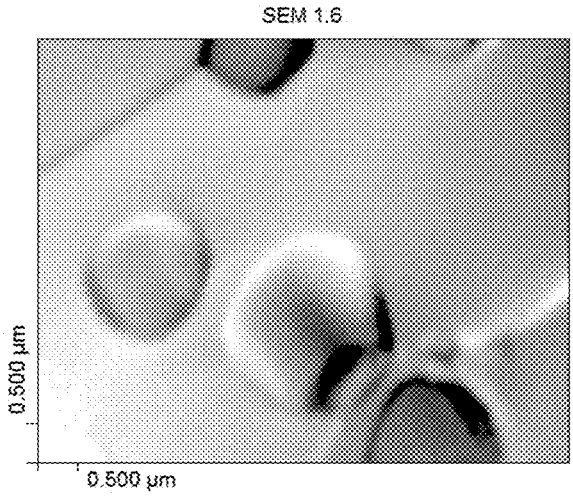
Figure 3B:
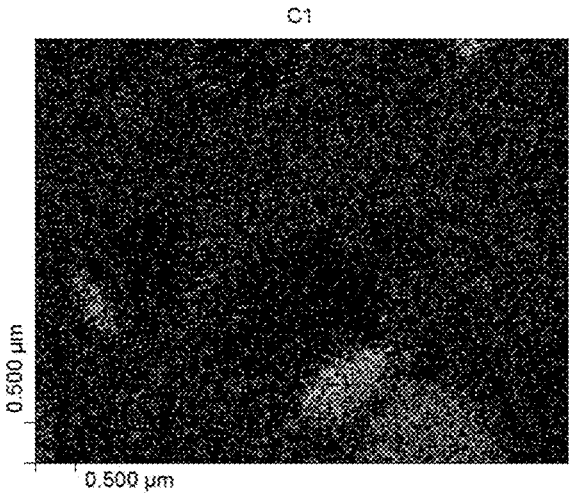
Figure 3C:
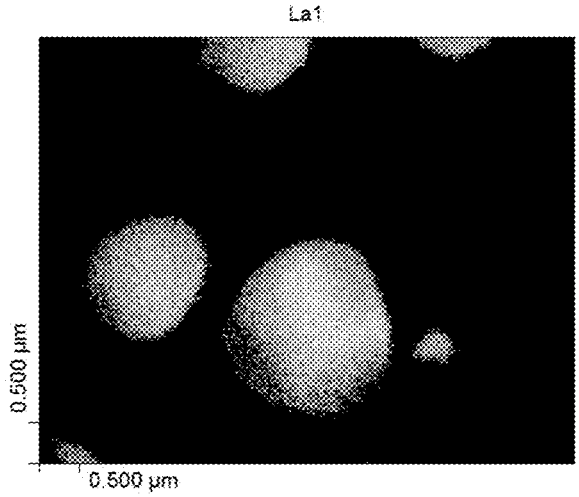
Figure 3D:
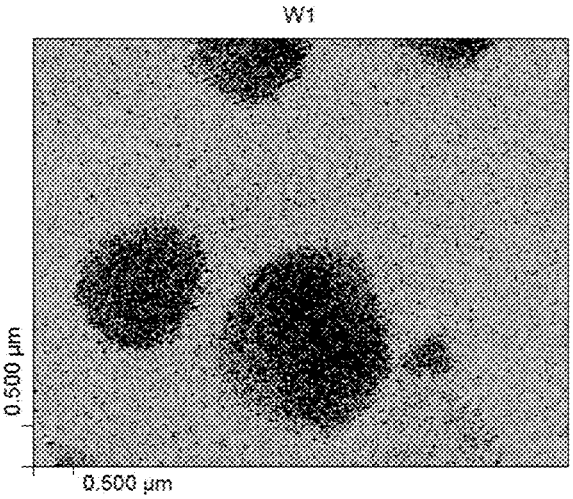
Figure 4A:
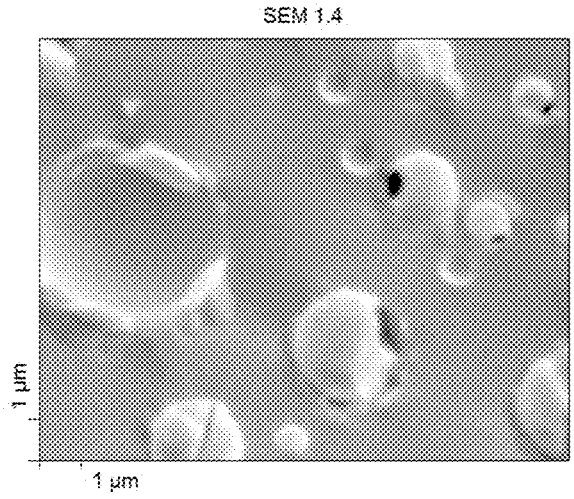
FIGS. 4*a*-4*d* secondary electron image of a fracture surface (4*a*) and element distributions determined by means of Auger Electron Spectroscopy (AES): C (4*b*), La (4*c*) and W (4*d*), diffusion step at 2700° C.
Figure 4B:
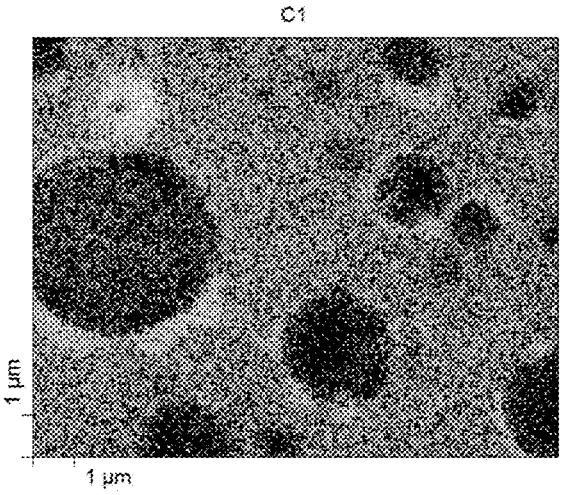
Figure 4C:
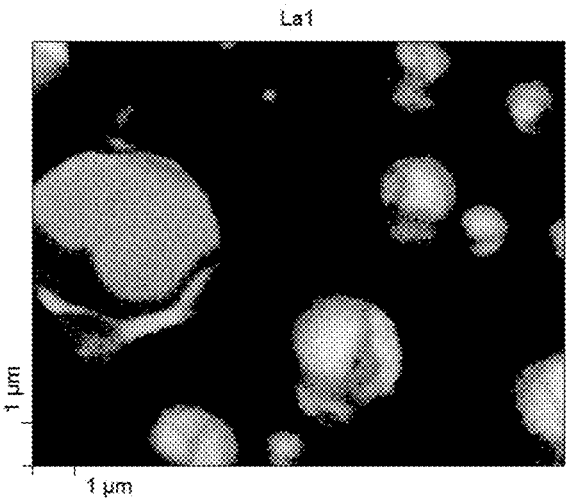
Figure 4D:
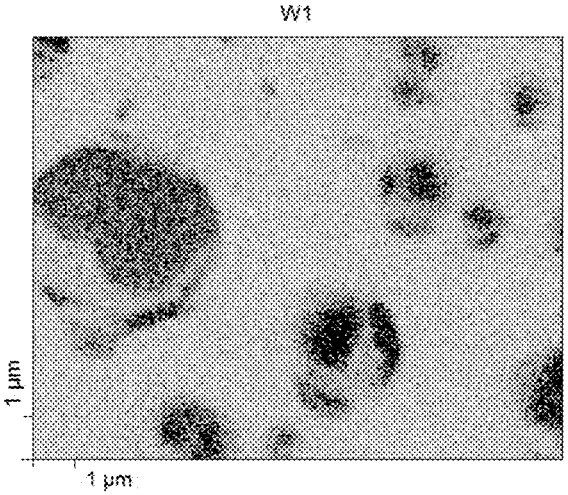

FIGS. 3*a* to 3*d* show scanning electron micrographs of a fracture surface of a cathode material. In FIG. 3*a*, an analysis based on secondary electrons of a fracture surface was carried out. In FIGS. 3*b* to 3*c*, element distributions determined by means of Auger Electron Spectroscopy (AES) were analyzed on the same section of the image: C (3*b*), La (3*c*) and W (3*d*).

To interpret the images, it should be noted that light-colored regions correspond to a relatively high concentration of the respective element.

It can be seen from FIG. 3*b* that the carbon preferentially accumulates in the vicinity of the lanthanum-containing particles.

The cathode material of this working example was subjected to a diffusion step at 2200° C.

FIGS. 4*a* to 4*d* show images analogous to FIGS. 3*a* to 3*d* but in this case the carbon material was subjected to a diffusion step at 2700° C. It can be seen from a comparison with FIGS. 3*a*-3*d* that after a heat treatment at higher temperature, the carbon has formed marked seams around the lanthanum-containing particles.

In addition, it can be seen that a higher carbon concentration compared to FIG. 3 is present at the grain boundaries. Since the present figures show images of fracture surfaces of an intercrystalline fracture, the view is of the grain boundaries.

Figure 5A:
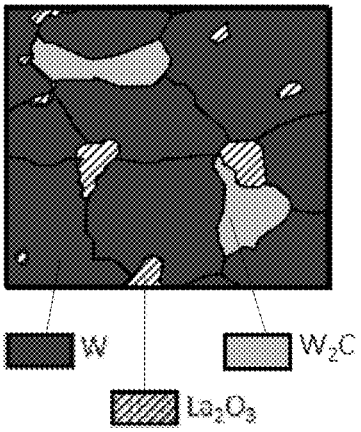
FIG. 5*a*-5*c* schematic depictions of the mechanism of formation of carbide of the emitter element for the example of lanthanum FIG. 6 phase analysis from EDX FIG. 7 a schematic depiction of the microstructure FIG. 8 a schematic depiction of a high-pressure discharge lamp FIG. 9 a graph of the course of the temperature in production of the cathode material
Figure 5B:
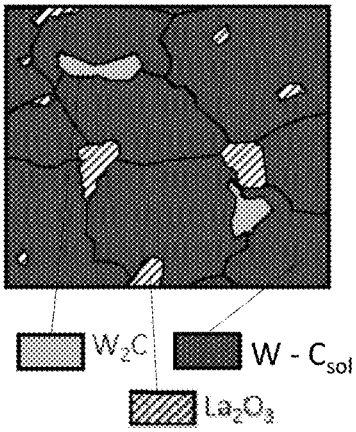
Figure 5C:
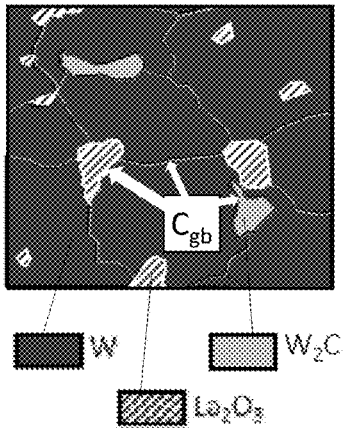

FIGS. 5*a* to 5*c* schematically show the development of the microstructure in the cathode material due to the precipitation heat treatment (diffusion step and precipitation step). Beginning from the initial state comprising $La_2O_3$, W and $W_2C$ in FIG. 5*a*, the size of the $W_2C$ grains decreases at the maximum temperature (FIG. 5*b*) because of increased solubility of C in W. In FIG. 5*b*, the tungsten grains with dissolved carbon are denoted by W—$C_{sol}$.

FIG. 5*c* shows the microstructure after cooling:

During cooling (precipitation step), the solubility of C in W decreases, which leads to precipitation at the grain boundaries. C is preferentially precipitated in the vicinity of the $La_2O_3$ grains, which is indicated by their white periphery in FIG. 5*c*. The carbon precipitated at grain boundaries (of $La_2O_3$ and of W) is denoted by $C_{gb}$.

It is not possible to draw any conclusions as to the grain size distribution or proportions by volume from this in-principle sketch.

Figure 6:
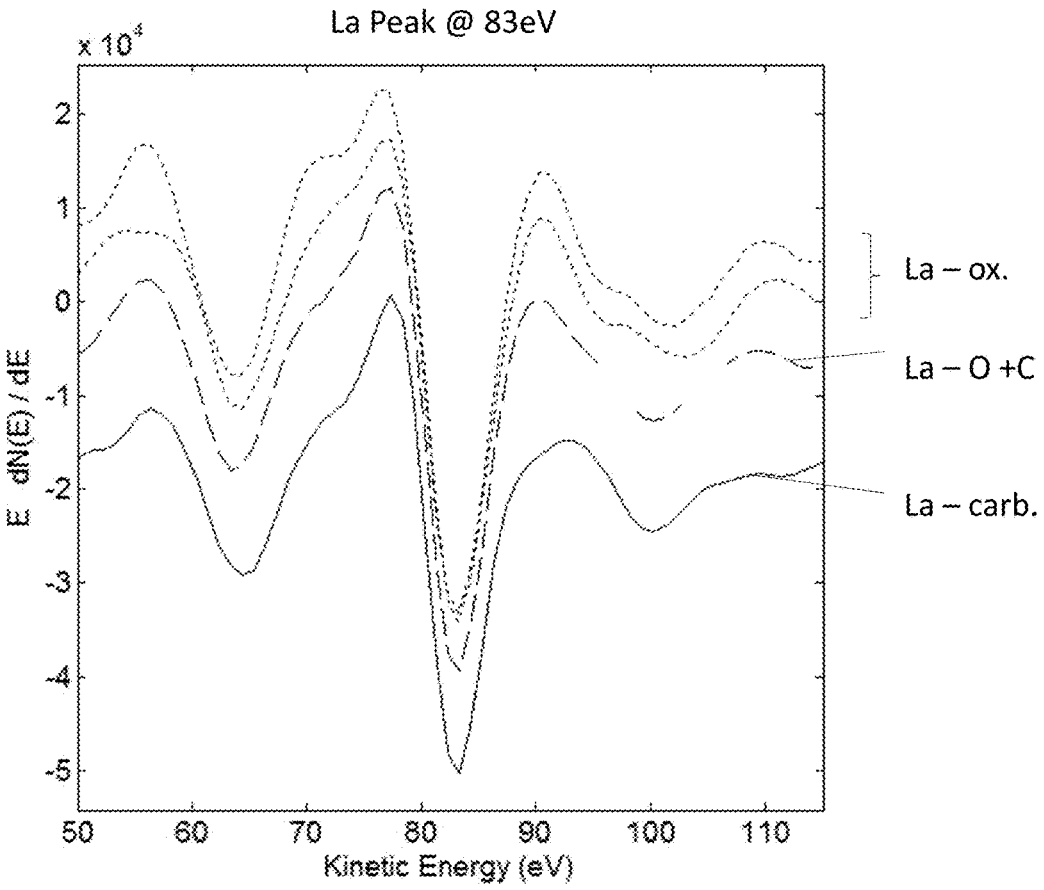

FIG. 6 shows, with the aid of a comparison of the profiles of the Auger electron emission over the energy spectrum which are characteristic of the different phases, that lanthanum is present in oxidic form, in carbidic form and in a mixed form (La with 0 and C).

Figure 7:
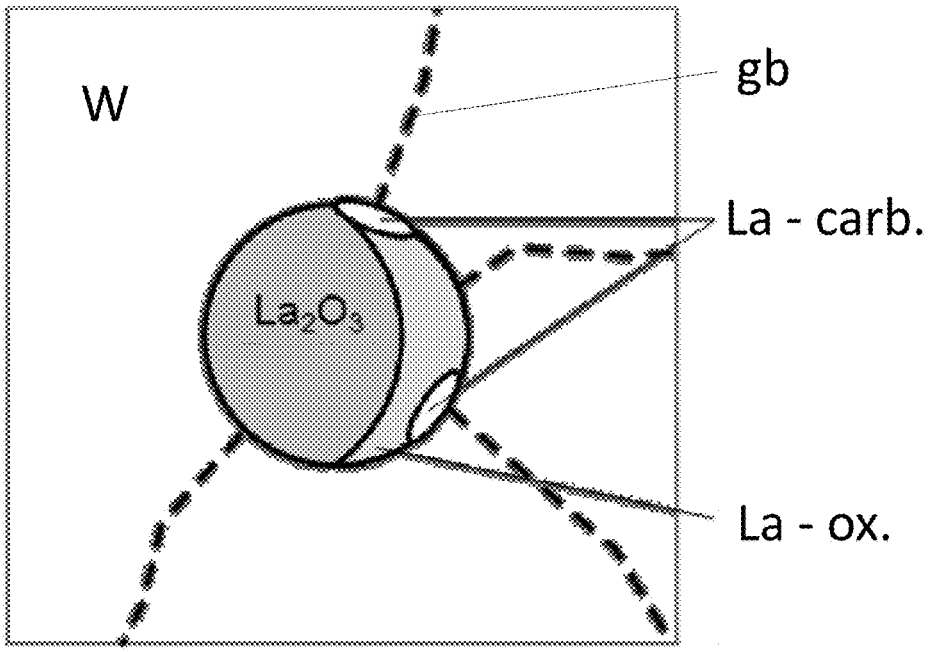

FIG. 7 schematically shows the microstructure after a heat treatment at 2700° C. A section comprising tungsten grains W with grain boundaries gb and a lanthanum oxide particle at a triple point is depicted. After the diffusion step at 2700° C., not only $La_2O_3$ but also a carbidic form of lanthanum (designated as La—carb.) is found. In addition, there are regions (denoted by La—ox.) in which the $La_2O_3$ has already been subjected to incipient reduction. The carbon accumulates, in particular, at the grain boundary triple points since the diffusion of carbon along grain boundaries is significantly faster than in the volume.

Figure 8:
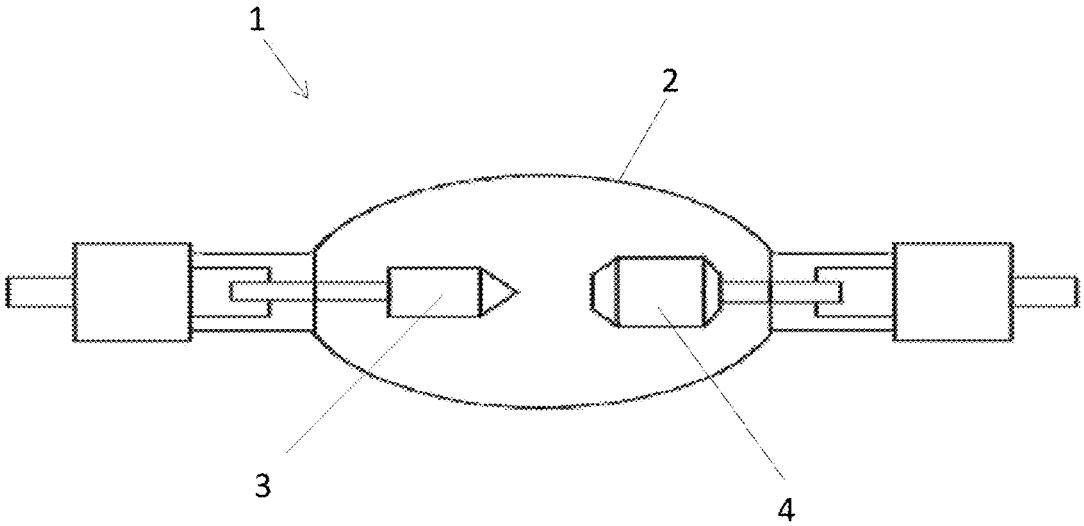

FIG. 8 schematically shows a high-pressure discharge lamp 1 with a discharge vessel (bulb) 2. During operation, a discharge arc is formed between a cathode 3 and an anode 4. A high-pressure discharge lamp 1 having a cathode 3 composed of the cathode material of the invention is free of thorium and has an at least equally long life and a similarly low or lower arc instability as a lamp having a thoriated cathode.

Figure 9:
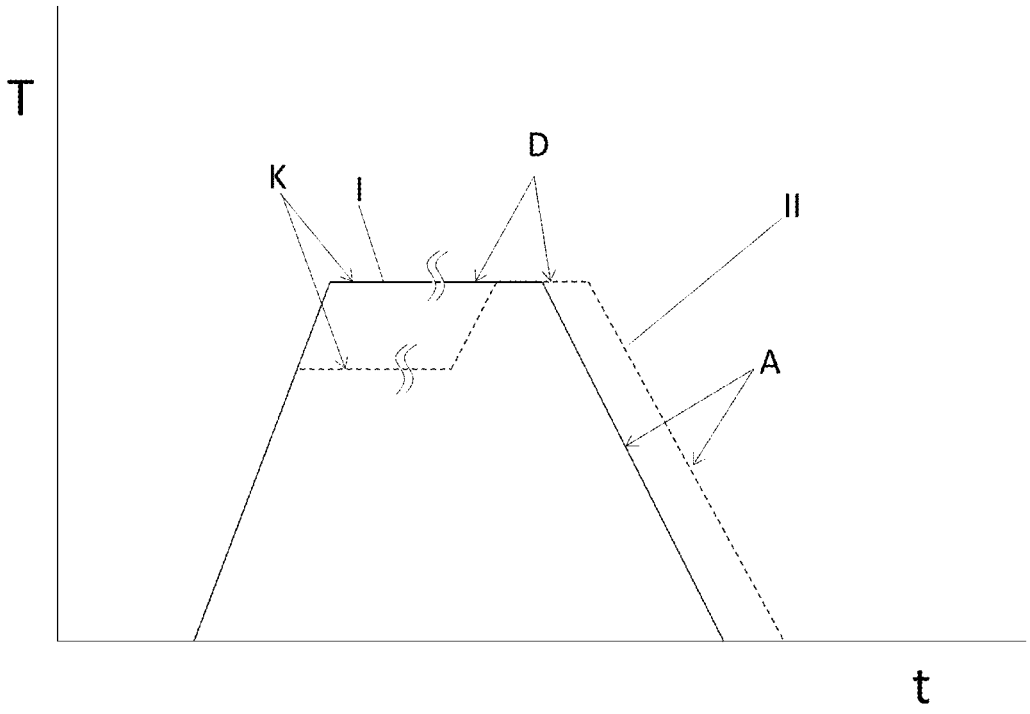

FIG. 9 schematically shows, by way of example, courses of the steps consolidation step K, diffusion step D, precipitation step A for producing the cathode material in a graph of temperature T over time t.

In variant I, the consolidation step K and the diffusion step D are carried out in one step. In the variant II, the consolidation step K is carried out at a relatively low temperature and is followed by a separate diffusion step D at higher temperature.

It is also conceivable for the consolidation step K and the diffusion step D to be separated in time and in space.

PRODUCTION EXAMPLES

To produce the cathode material, the alloy constituents were used in the form of powders. Lanthanum was added in the form of lanthanum hydroxide, with a proportion by mass of 2.33% by weight being weighed in. The addition of C was effected in the form of flame black or as WC powder. The C content was varied in the range from 240 μg/g to 5800 μg/g in the working examples in order to examine the influence of this parameter on the burning behavior in the short electric arc lamp. The concentrations of carbon indicated are final contents in the finished cathode material. The powders were mixed in a conventional plowshare mixer.

Different processes were employed for compaction of the powder mixture. One method is cold isostatic pressing (CIP). Here, the powder was introduced into the pressing tool consisting of a rubber hose and a metal cage, closed tightly and pressed at a pressure of 2000 bar. An alternative to compaction by means of the CIP process is hot pressing. Here, the powder was introduced into a cylindrical graphite mold and a pressure of 200 bar was applied at a temperature of 1000° C., which was attained by direct passage of electric current. This process took place in a protective gas atmosphere.

Sintering of the compact is typically carried out in an $H_2$ atmosphere. As an alternative, the use of hot pressing was demonstrated in further working examples. Here, the cylindrical compact was heated via the end faces with direct passage of electric current and sintered with application of pressure. This process took place in a protective gas atmosphere. In general, a temperature of greater than or equal to 2200° C. was employed for sintering. Alternative methods for further densification of the material were also demonstrated in the working examples. One possibility is hot isostatic pressing (HIP). A density close to the theoretical density is achieved thereby. As an alternative thereto, densification can be achieved by forming. In some working examples, flat forging of a cylindrical geometry was demonstrated. A density close to the theoretical density was achieved in this way, similarly to the HIP process.

In the following working examples, compositions and relative densities of cathode materials were varied and the cathode materials were subsequently evaluated in lamp tests.

The studies were carried out on mercury discharge lamps with lithography applications having a nominal power of 3.5 kW. To compare the performance of the various experimental lamps, the dimensional stability of the cathodes (measured by means of the plateau enlargement), the burning-back of the cathode and also the stability of the arc behavior (flickering) are examined. To assess flickering, the arc voltage U of the lamp was measured. The background here is that flickering of the electric arc is associated with a fluctuation in the arc voltage, with the latter being significantly easier to measure than the fluctuation in the light yield. The lamps were operated for a time of 1500 h (nominal life).

Variation of the Carbon Content of the Cathode Material

The results on 7 lamps A, B, C, D, E, F and G are described below. These are lamps having different cathode materials but are otherwise of identical construction. Lamp A contains a thoriated cathode (prior art) having a $ThO_2$ content of 1.8% by weight. The cathode of the lamp B was made of the material WLZ (W+2.5% by weight of $La_2O_3$+0.07% by weight of $ZrO_2$). Lamp C has the same construction as B but in the case of lamp C the WLZ cathode was carburized on the surface and the tip region (to 3 mm behind the plateau) was etched free.

In the case of the lamps D, E, F and G, carbon was added to the bulk of the cathode material. The concentrations of carbon were 240 μg/g (D), 350 μg/g (E), 750 μg/g (F) and 5800 μg/g (G). Table 1 shows the results for these lamps in respect of flickering, dimensional stability and burning-back of the cathode.

TABLE 1

C content and test results of the lamps A to G

| Lamp | C content in the cathode material [μg/g] | Flicker-free operating time [h] | Diameter of the cathode plateau after 100 h relative to 0 h [%] | Electrode spacing after 1000 h relative to 0 h [%] |
|---|---|---|---|---|
| A | — | >1500 | 206 | 108 |
| B | — | 40 | 382 | 124 |
| C | Surface carburization | 580 | 293 | 113 |
| D | 240 | 50 | 500 h: 312 | 500 h: 117 |
| E | 350 | >1500 | 160 | 107 |
| F | 750 | >1500 | 170 | 109 |
| G | 5800 | >1500 | 309 | 115 |

The lamp having a WLZ cathode (lamp B) begins to flicker after only 40 hours, see 3rd column in table 1 above. Exterior carburization of this cathode (lamp C) increases the flicker-free time to 580 hours, but the times of the thoriated lamp (lamp A) cannot be attained. At higher carbon contents (lamps E, F and G), the lamps can be operated flicker-free over the entire nominal life and beyond. It is apparent here that a minimum amount of carbon has to be present. Thus, the lamp containing 240 μg/g of carbon (lamp D) does not behave any better than the lamp having the WLZ cathode (lamp B) and begins to flicker after only 50 hours. The carbon content of lamp D is obviously too low.

The deformation and the burning-back are listed in the two right-hand columns of the above table. Lamp G containing 5800 μg/g of carbon displays great plateau enlargement and high burning-back: both values are even above those of lamp C having the carburized WLZ cathode. The reason for this is that the high-temperature strength and creep resistance of the cathode material decrease with increasing proportion by volume of $W_2C$. The cathodes of the lamps without and with a carbon content which is too low (lamps B, C and D) likewise deform severely. In these lamps, the flickering indicates temporary depletion of emitter element (lanthanum or lanthanum oxide) at the cathode tip. As a result, the temperature increases at the cathode tip, which leads to greater deformation. The cathodes of the lamps E and F display very low deformation and also low burning-back. Both parameters are comparable to those for the thoriated reference (lamp A) and are sometimes even lower.

A carbon content of 350 μg/g or 750 μg/g obviously ensures constant resupply of the emitter element to the cathode tip, without adverse effects on the dimensional stability and the burning-back behavior.

Variation of the Relative Density of the Cathode Material

The effect of redensification of the cathode material after the sintering process will now be demonstrated with the aid of the test results for lamps H, I and J, which apart from the cathode material have an identical construction to the lamps A-G. The cathode of lamp H was used in the sintered state. The cathode materials used in the lamps I and J were densified by flat forging or by an HIP process. Accordingly, these two materials have a higher density than the material which has merely been sintered. The production route for these three cathode materials is comparable, and the cathode content of 630 μg/g is in the identified target range. The lamp test data are summarized in table 2.

TABLE 2

Test data for the lamps H to J having different densities of the cathode material

| Lamp | Densification | Density [g/cm³] | Diameter of the cathode plateau after 1000 h relative to 0 h | Electrode spacing after 1100 h relative to 0 h |
|---|---|---|---|---|
| H | None | 17.86 (96.2%) | 213% after 500 h | 106.4% after 500 h |
| I | Flat forging | 18.25 (98.3%) | 150% | 105.9% |
| J | HIP | 18.52 (99.8%) | 180% | 107.0% |

The lamps H, I and J burned in a stable manner during the entire test time and no flickering occurred. The test on lamp H was stopped after 500 hours because of excessive deformation of the cathode plateau. This negative test result is attributed to the residual porosity of the cathode material which leads to a rise in the tip temperature because of the reduced thermal conductivity. In addition, the residual porosity decreases the strength and creep resistance at high temperature. The densified cathode materials display characteristics which are comparable to those of the thoriated cathode or are superior to these in respect of some properties.

Variation of the Maximum Temperature during the Diffusion Step in the Production of the Cathode Material As demonstrated above with the aid of the figures, a higher temperature in the diffusion step in the production of the cathode material leads to increased formation of carbidic phases of the emitter element. In the following, two cathode materials (cathodes of lamps K and L) for which the temperature during the diffusion step was varied will be compared. The cathodes of lamps K and L have the same construction as the specimens A to J. Density and carbon content of both materials are in the optimal range of values.

TABLE 3

Results of lamp test on lamps H and I having a different maximum temperature in the diffusion step

| Lamp | Maximum temperature in diffusion step [° C.] | Flicker-free operating time [h] | Diameter of the cathode plateau after 1000 h relative to 0 h in % | Electrode spacing after 1000 h relative to 0 h in % |
|---|---|---|---|---|
| K | 2100 | 540 | 207 | 112.8% |
| L | 2200 | >1500 | 170% | 110% |

The lamp K with a maximum temperature of 2100° C. in the diffusion step attains a flicker-free operating time of 540 hours. The lamp L with a maximum temperature of 2200° C. in the diffusion step, on the other hand, attains a flicker-free operating time of more than 1500 hours.

This can be interpreted as meaning that there is insufficient reduction of emitter oxide and formation of carbidic phases of the emitter element in the cathode material at a maximum temperature of less than 2200° C. in the diffusion step and the lamp is not supplied sufficiently with emitter element during operation.

If the process is carried out at a maximum temperature of 2200° C. or above, the reduction of lanthanum oxide in the material is accelerated. A carbidic bonding state of lanthanum is observed to an increased extent. This bonding state is preferentially attained at triple points of the microstructure because the diffusion of C is accelerated along the grain boundaries compared to the bulk diffusion in the interior of the grain.

The invention claimed is:

1. A cathode material for use in a high-pressure discharge lamp, the cathode material comprising:

a matrix based on tungsten having a tungsten content of greater than or equal to 95% by weight;

tungsten carbide;

oxides and/or predominantly oxidic phases of at least one first emitter element selected from the group consisting of rare earth metals, Hf, and Zr, wherein said predominantly carbidic phases being present as shell or seam structure around an oxide of said at least one first emitter element; and predominantly carbidic phases of at least one second emitter element selected from the group consisting of said rare earth metals, said Hf, and said Zr.

2. The cathode material according to claim 1, wherein said first and second emitter elements are said rare earth metals.

3. The cathode material according to claim 1, wherein said tungsten carbide is $W_2C$.

4. The cathode material according to claim 1, wherein a proportion of said tungsten carbide is in a range from 0.1 to 4% by volume.

5. The cathode material according to claim 1, wherein a carbon content being 50-3000 μg/g.

6. The cathode material according to claim 1, wherein a proportion of emitter material, based on a proportion by weight when added as an oxide, is in a range from 0.5 to 5% by weight.

7. The cathode material according to claim 1, wherein said at least one first emitter element which is present as an oxide and/or predominantly an oxidic phase is formed by lanthanum.

8. The cathode material according to claim 1, wherein said at least one second emitter element which is present as a predominantly carbidic phase is present in a predominantly carbidic form and/or as the predominantly carbidic phase and is formed by lanthanum.

9. The cathode material according to claim 8, wherein both said first emitter element which is present as an oxide and/or a predominantly oxidic phase and also said second emitter element which is present in the predominantly carbidic form and/or as the predominantly carbidic phase is formed by lanthanum.

10. The cathode material according to claim 1, wherein said predominantly carbidic phases of said at least one second emitter element adjoin said predominantly oxidic phases of said at least one first emitter element.

11. The cathode material according to claim 1, wherein said shell or seam structure has an average thickness of from 0.01 to 1 μm.

12. The cathode material according to claim 1, wherein the cathode material has a relative density of greater than or equal to 92%.

13. A high-pressure discharge lamp, comprising:

a cathode composed of a cathode material according to claim 1.

14. A process for producing a cathode material, which comprises the steps of:

producing a powder mixture containing tungsten powder, at least one emitter element from the group consisting of rare earth metals, Hf and Zr and at least one carbon source;

pressing of the powder mixture;

consolidation of the powder mixture in a consolidation step;

performing a diffusion step in a form of a heat treatment to bring about homogeneous distribution of carbon in the cathode material; and performing a precipitation step in a form of cooling to provide a carbon depot adjacent to a phase containing the at least one emitter element.

15. The process according to claim 14, wherein the diffusion step takes place at temperatures of greater than or equal to 2200° C. but less than 3000° C.

16. The process according to claim 14, wherein predominantly carbidic phases of the at least one emitter element is formed by the precipitation step.

17. The process according to claim 14, wherein the precipitation step is carried out at a cooling rate of from 1 K/min to 500 K/min.

* * * * *